US005756278A

United States Patent [19]

Lok

[11] Patent Number: 5,756,278

[45] Date of Patent: May 26, 1998

[54] COMBINATION OF DITHIOLONE DIOXIDES WITH GOLD SENSITIZERS IN AGCL PHOTOGRAPHIC ELEMENTS

[75] Inventor: Roger Lok, Rochester, N.Y.

[73] Assignee: Eastman Kodak Company, Rochester, N.Y.

[21] Appl. No.: 885,483

[22] Filed: Jun. 30, 1997

Related U.S. Application Data

[63] Continuation-in-part of Ser. No. 770,315, Dec. 20, 1996, abandoned.

[51] Int. Cl.[6] ..... G03C 1/09; G03C 1/34

[52] U.S. Cl. ..... 430/600; 430/605; 430/611; 430/613; 430/614

[58] Field of Search ..... 430/600, 603, 430/605, 611, 613, 614

[56] References Cited

U.S. PATENT DOCUMENTS

| | | | |
|---|---|---|---|
| 3,503,749 | 3/1970 | Tavernier et al. | 430/605 |
| 5,003,097 | 3/1991 | Beaucage et al. | 558/129 |
| 5,049,485 | 9/1991 | Deaton | 430/605 |
| 5,116,723 | 5/1992 | Kajiwara et al. | 430/611 |
| 5,266,442 | 11/1993 | Ooms et al. | 430/605 |
| 5,670,307 | 9/1997 | Lok | 430/611 |
| 5,693,460 | 12/1997 | Lok | 430/611 |

*Primary Examiner*—Richard L. Schilling
*Attorney, Agent, or Firm*—Paul A. Leipold

[57] ABSTRACT

The invention relates to a silver halide photographic emulsion comprising a silver halide emulsion wherein the grains of said emulsion comprise silver chloride said grains are sensitized with a water soluble gold(I) or (III) compound, and said emulsion further comprises a dithiolone dioxide.

19 Claims, No Drawings

COMBINATION OF DITHIOLONE DIOXIDES WITH GOLD SENSITIZERS IN AGCL PHOTOGRAPHIC ELEMENTS

CROSS-REFERENCE TO RELATED APPLICATIONS

This is a continuation-in-part of application Ser. No. 08/770,315 filed Dec. 20, 1996, now abandoned, entitled "NOVEL COMBINATION OF DITHIOLONE DIOXIDES WITH GOLD SENSITIZERS IN AGCL PHOTOGRAPHIC ELEMENTS" by Roger Lok.

FIELD OF THE INVENTION

This invention relates to the use of certain dioxide compounds in combination with water soluble gold compounds to obtain improved speed and other improved properties in photographic elements.

BACKGROUND OF THE INVENTION

In the formation of photographic elements, particularly color paper, there is continuing need for photographic elements that provide improved performance. Of particular interest are improvements that provide greater speed to a photographic element such that the element will not require as much light exposure to obtain the desired image. Another area of continued interest is the performance of the photographic element with respect to detail in the low exposure or light colored areas of the print. The light colored areas such as in white dresses, snow covered areas, and white animals, such as polar bears, are particularly hard to photographically print with detail showing in shading changes. Another area of difficulty is the high-exposure areas of high density where it is again difficult to form images that have sufficient detail in the folds and shadow areas of images of things like dark suits, dark forests, rocks, and shadow areas. The high exposure areas (high density) are called the shoulder areas of the sensitometric curve for color paper, whereas the low exposure (low density) areas are called the toe of the sensitometric curve for color papers. While there is an interest in detail of low density areas and high density areas in all photographic elements in motion picture film and color negative film, an area of great interest is color paper, particularly that used in wedding photography. In wedding photography, the dresses tend to be light and the suits dark, thereby maximizing the need for detail in low density areas and high density areas in the same print.

Photographic elements that have improved speed allow the use of smaller flash elements for exposures, thereby either increasing how rapidly the flash may be cycled or allowing the use of a cheaper lower cost flash.

There is also an interest, particularly in color paper, in having prints that have more contrast. Prints that have more contrast exhibit the advantage that they have saturated colors and rich details in shadow areas.

Organic compounds having a polysulfur linkage comprised of three or more sulfur atoms, and organic compounds having a heterocyclic ring having at least two thioether linkages or at least one disulfur linkage, such as those described in U.S. Pat. No. 5,116,723, in combination with nitrogen-containing cyclic compounds have also been discussed as suppressing fog and improving raw stock stability.

PROBLEM TO BE SOLVED BY THE INVENTION

There remains a need for photographic materials, particularly color papers, that have improved speed, better detail in light colored area, and better detail in high density area of prints. There is also a need for improved contrast in photographic prints.

SUMMARY OF THE INVENTION

An object of the invention is to overcome disadvantages of prior photographic elements.

A further object is to provide photographic element with improved toe and shoulder performance.

Another further object is to provide a photographic element having improved contrast.

These and other objects of the invention generally are met by providing a silver halide photographic emulsion comprising a silver halide emulsion wherein the grains of said emulsion comprise silver chloride said grains are sensitized with a water soluble gold(I) or gold(III) compound, and said emulsion further comprises a dithiolone dioxide of Formula I

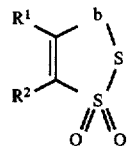

(I)

wherein b is C(O), C(S), C(Se), $CH_2$ or $(CH_2)_2$ and $R^1$ and $R^2$ are independently H or a substituted or unsubstituted aliphatic, aromatic, or heterocyclic group, provided that $R^1$ and $R^2$ together can optionally be joined to form a ring.

ADVANTAGEOUS EFFECT OF THE INVENTION

The photographic elements of the invention have the advantage of improved detail in low density areas of a photographic element, particularly colored paper. The emulsions of the invention also provide photographic elements having improved detail in the dark high density areas of a photograph.

DETAILED DESCRIPTION OF THE INVENTION

The invention has numerous advantages over prior emulsions and photographic elements. The photographic elements of the invention have improved detail in shadow areas and improved detail in light areas. Further, the contrast of the elements is improved and provides a higher gamma. The emulsions and photographic elements of the invention also have higher speed, thereby allowing for exposure with less light intensity. These and other advantages of the invention will be apparent from the detailed description below.

Dithiolone dioxides of the invention are a class of organic compound known as having a five-membered heterocyclic ring represented by formula (I):

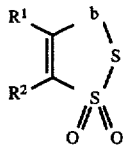

(I)

wherein b is C(O), C(S), C(Se), $CH_2$ or $(CH_2)_2$ and$R^1$ and $R^2$ may be independently H or a substituted or unsubstituted aliphatic, aromatic, or heterocyclic group or $R^1$ and $R^2$ together represent the atoms necessary to form a ring or multiple ring system.

When $R^1$ and $R^2$ are aliphatic groups, preferably, they are alkyl groups having from 1 to 22 carbon atoms, or alkenyl or alkynyl groups having from 2 to 22 carbon atoms. More preferably, they are alkyl groups having 1 to 8 carbon atoms, or alkenyl or alkynyl groups having 3 to 5 carbon atoms. These groups may or may not have substituents. Examples of suitable alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms. These groups may have substituent groups. The heterocyclic groups are 3- to 15-membered rings with at least one atom selected from nitrogen, oxygen, sulfur, selenium, and tellurium. More preferably, the heterocyclic groups are 5- to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Preferably, $R^1$ and $R^2$ together form a ring or multiple ring system. The ring and multiple ring systems formed by $R^1$ and $R^2$ may be alicyclic or they may be the aromatic and heterocyclic groups described above. In a preferred embodiment, $R^1$ and $R^2$ together form a 5- or 6-membered ring, preferably, an aromatic ring. Most preferably, the dioxide compound is 3H-1,2-benzodithiol-3-one-1,1-dioxide (Compound A).

It is understood throughout this specification and claims that any reference to a substituent by the identification of a group containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form, but also its form substituted with any substituents which do not negate the advantages of this invention.

Nonlimiting examples of substituent groups include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl and alkoxy groups (for example, methyl and methoxy).

Specific examples of the dithiolic compounds include, but are not limited to:

1

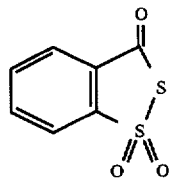

2

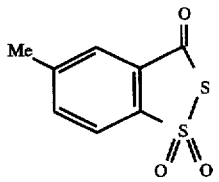

3

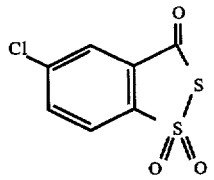

4

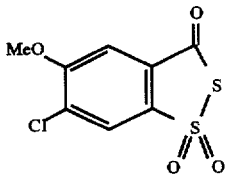

5

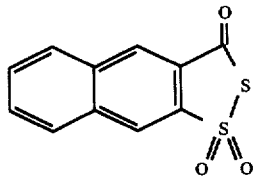

6

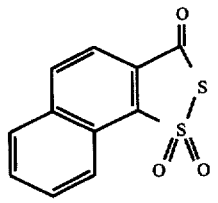

7

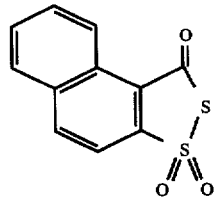

8

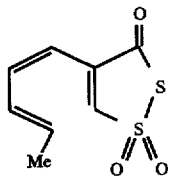

-continued
9
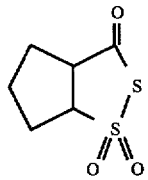
10
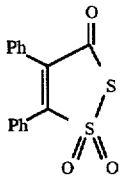
11
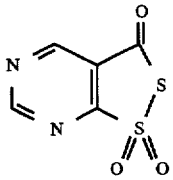
12
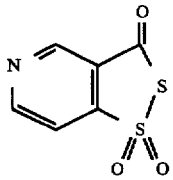
13
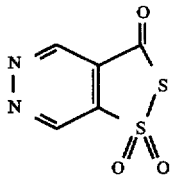
14
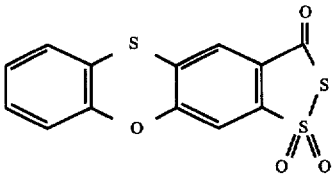
15
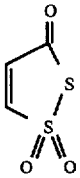
16
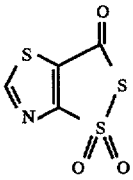
-continued
17
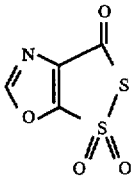
18
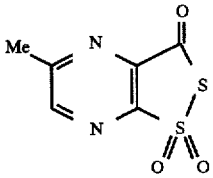
19
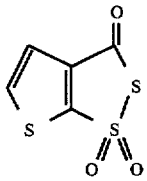
20
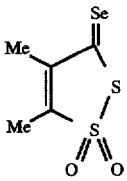
21
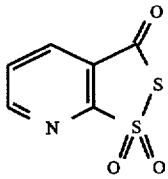
22
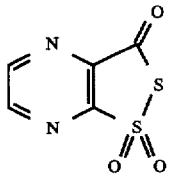
23
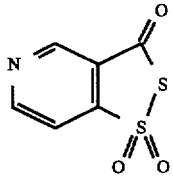
24
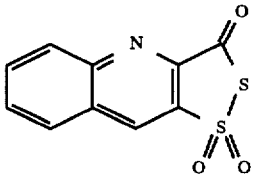

-continued

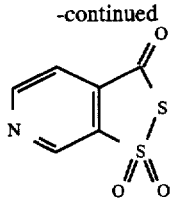

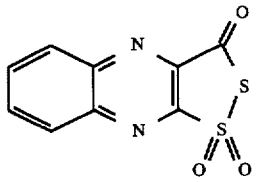

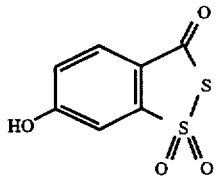

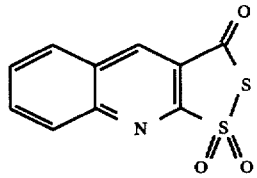

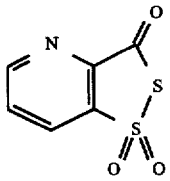

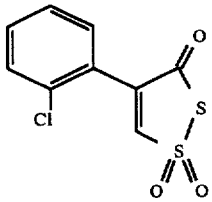

The water soluble gold sensitizers of the present invention may be either gold(I) or gold(III) compounds. The soluble gold(I) compounds may include trisodium aurous dithiosulfate, dithiocyanatoaurate or the gold(I) thiolate compounds described in Tavernier et al U.S. Pat. No. 3,503,749 or the mesoionic gold(I) compounds described in U.S. Pat. No. 5,049,485. Soluble gold(III) compounds include potassium tetrachloroaurate. The gold compounds of the present invention are all water soluble. Colloidal or water insoluble gold sulfide is specifically excluded from the present invention. The preferred water soluble gold(I) and (III) compounds are bis(1,4,5-trimethyl-1,2,4-triazolium-3-thiolate) gold(I) tetrafluoroborate and potassium tetrachloroaurate. The insoluble gold sulfides and colloidal gold sulfides are excluded from the invention, as they have the disadvantage that there is considerable sensitometric variability when used as sensitizers.

The dioxide compounds of this invention may be added to the photographic emulsion using any technique suitable for this purpose. They may be dissolved in most common organic solvents. Methanol solutions, however, are to be specifically avoided because of the propensity of this class of compound to decompose in organic hydroxylic solvents. Examples of suitable solvents include methyl ethyl ketone and acetone. The dioxide compounds can be added to the emulsion in the form of a liquid/liquid dispersion similar to the technique used with certain couplers. They can also be added as a solid particle dispersion.

The dioxide compounds of the invention may be used in addition to any conventional emulsion stabilizer or antifoggant as commonly practiced in the art. Combinations of more than one dioxide compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The dioxide may be added to the silver halide emulsion at any time during the preparation of the emulsion, i.e., during precipitation, during or before chemical sensitization or during final melting and co-mixing of the emulsion and additives for coating. More preferably, the compound is added during or after chemical sensitization, and most preferably during.

The silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubooctahedrons, or any of the other naturally occurring morphologies of cubic lattice type silver halide grains. Further, the grains may be irregular such as spherical grains or tabular grains. Grains having a tabular or cubic morphology are preferred.

The photographic emulsions incorporating the dioxide may be incorporated into color negative (particularly color paper) or reversal photographic elements. The photographic element may, also comprise a transparent magnetic recording layer such as a layer containing magnetic particles on the underside of a transparent support, as described in *Research Disclosure*, November 1992, Item 34390 published by Kenneth Mason Publications, Ltd., Dudley House, 12 North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley House, 12 North Street, Emsworth, Hampshire PO10 7DQ, ENGLAND, and such as the Advanced Photo System, particularly the Kodak ADVANTIX films or cameras. The dioxides of the invention find their preferred use in color paper.

In the following Table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley House, 12 North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley House, 12 North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, | morphology and preparation. Emulsion preparation |
| 3 | XIV, XV, I, II, III, IX A & B | including hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Wash-out |
| 3 | X | couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

One method of preparing an aromatic 3H-1,2-dithiol-3-one 1,1-dioxide is via the cyclization of an ortho substituted aryl mercaptocarboxylic acid in the presence of thiolacetic acid. This is followed by oxidation of the product with hydrogen peroxide as described in *OPPI Briefs* 24, #4, 488 (1992). Alternatively, this class of compounds may be purchased commercially.

Useful levels of dithiolone dioxides may range from 0.001 mg to 1000 mg per silver mole. Preferred range may be from 0.01 mg to 500 mg per silver mole. A more preferred range is from 0.1 mg to 100 mg per silver mole. The most preferred range is from 1 mg to 50 mg/Ag mole. Useful levels of Au compounds may range from 0.0001 mg to 1000 mg per silver mole. Preferred range may be from 0.001 mg to 100 mg per silver mole. A more preferred range is from 0.01 mg to 50 mg per silver mole. The most preferred range is from 0.1 mg to 10 mg/Ag mole.

The ratio of dithiolone dioxides to gold compounds may be anywhere from 100:1 to 1:0.1 in molar equivalence. The compounds may be added any time during the preparation of the emulsion, but the preferred time of addition is during the sensitization of the emulsion. Gold salts of the invention are most conveniently dissolved in water.

The following examples illustrate the practice of this invention. They are not intended to be exhaustive of all possible variations of the invention.

EXAMPLES

Example 1

In accordance with the present invention, compound 1 and potassium tetrachloroaurate in amounts indicated in Table 1 were added to a 0.3 mol silver chloride emulsion at 40° C. The emulsion was sensitized with a blue spectral sensitizing dye, anhydro-5-chloro-3,3'-di(3-sulfopropyl) naphtho[1,2-d] thiazolothiacyanine hydroxide triethylammonium salt (220 mg/Ag mol), a gelatin dispersion of a fine grain silver bromide (0.6 mol %), along with tetraazaindene (150 mg/Ag mol). The emulsion was heated to 60° C. at a rate of 10° C. per 6 minutes and then held at this temperature for 35 minutes. The emulsion was cooled back to 40° C. at a rate of 10° C. per 6 minutes, and 1-(3-acetamidophenyl) -5-mercaptotetrazole (68 mg/Ag mol), was added. This emulsion further contained a yellow dye-forming coupler alpha-(4-(4-benzyloxy-phenyl-sulfonyl)phenoxy)-alpha (pivalyl)-2-chloro-5-(gamma-(2,4-di-5-amylphenoxy) butyramido)acetanilide (1.08 g/m$^2$) in di-n-butylphthalate coupler solvent (0.27 g/m$^2$), gelatin (1.51 g/m$^2$). The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tunsten lamp designed to stimulate a color negative print exposure source. This lamp had a color temperature of 3000K, log lux 2.95, and the coatings were exposed through a combination of magenta and yellow filters, a 0.3 ND (Neutral Density), and a UV filter. The processing consisted of a color development (45 sec. 35° C.), bleach-fix (45 sec. 35° C.) and stabilization or water wash (90 sec. 35° C.) followed by drying (60 sec. 60° C). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

Data in Table I show the speed, toe, shoulder and gamma values of coatings with the combination of Au(III) and compound 1. The speed taken at the 1.0 density point of the D log E curve is taken as a measure of the sensitivity of the emulsion. The toe value is taken at 0.3 log E exposure slow of the speed point at density 1. Customerily, the smaller the toe value, the sharper the toe. The shoulder value is taken at 0.3 log E fast of the speed point at density 1.0. Customerily, the bigger the shoulder value, the higher the shoulder. The gamma value is measured as the slope of the HD curve between the points at 0.3 log E fast of the speed point at density 1.0 and at 0.3 log E slow of the point at density 1.0. Customerily, the bigger the gamma value, the higher the contrast.

TABLE 1

| Sample | 1 | Au(III) | Speed | Toe | Shoulder | Gamma |
|---|---|---|---|---|---|---|
| 1 (invention) | none | 0 | im | im | im | im |
| 2 (comparison) | none | 0.15 Z | im | im | im | im |
| 3 (comparison) | none | 0.60 Z | im | im | im | im |
| 4 (comparison) | none | 1.50 Z | im | im | im | im |
| 5 (comparison) | Y | 0 | 128 | 0.381 | 2.230 | 1.719 |
| 7 (invention) | Y | 0.15 Z | 139 | 0.358 | 2.349 | 1.768 |

TABLE 1-continued

| Sample | 1 | Au(III) | Speed | Toe | Shoulder | Gamma |
|---|---|---|---|---|---|---|
| 8 (invention) | Y | 0.3 Z | 140 | 0.348 | 2.630 | 1.909 |
| 9 (invention) | Y | 1.5 Z | 144 | 0.314 | 2.659 | 1.926 |

*im is immmeasurable. Y is 4.59 mg/Ag mol, Z is 3.19 mg/Ag mol of $K_2AuCl_4$

It can be seen in Table 1 that the control (sample 1), which has neither 1 nor Au(III) compounds, has no measurable sensitivity. Comparison samples (2–4) that contain only the Au(III) compound also have no observable speed. Sample 5, containing only the thiolone dioxide has low speed, soft toe, low shoulder and low contrast. Samples of the present invention (7–9) having both Au(III) and compound 1 have higher speed than the comparison samples. It is also clear that the invention samples have a sharper toe, higher shoulder, and higher contrast than samples having only compound 1.

Example 2

In another practice of the invention, a negative silver chloride emulsion was sensitized with bis(1,4,5-trimethyl-1,2,4-triazolium-3-thiolate) tetrafluoroborate, (Au(I)), compound 1 and a comparative compound Q in amounts indicated in Table 2. In addition, there was added at 40° C., the green spectral sensitizing dye anhydro-5-chloro-9-ethyl-5'-phenyl-3-(3-sulfopropyl)-3'-(3-sulfobutyl)-oxacarbocyanine hydroxide triethylammonium salt, (380 mg/Ag mol).The emulsion was heated to 60° C. at a rate of 10° C. per 6 minutes, held at this temperature for 40 minutes and then cooled to 40° C. At this time, solutions of KBr (795 mg/Ag mol) and 1-(3-acetamidophenyl)-5-mercaptotetrazole (200 mg/Ag mol), were added. This emulsion further contained a magenta dye-forming coupler N-[4-chloro-3-[[4,5-dihydro-5-oxo-1-(2,4,6-trichlorophenyl)-1H-pyrazol-3-yl]amino] phenyl]-2-[3-(1,1-dimethylethyl)-4-hydroxyphenoxy]-tetradecanamide (0.389 g/m$^2$) in di-n-butylphthalate coupler solvent (0.195 g/m$^2$) and gelatin (1.27 g/m$^2$). The emulsion was similarly coated exposed and processed as for Example 1.

Compound Q

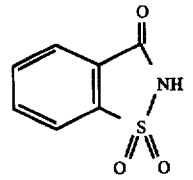

TABLE 2

| Sample | 1 | Q | Au(I) | Speed | Toe | Gamma |
|---|---|---|---|---|---|---|
| 10 (comparison) | 0 | 0 | 0 | 73 | 0.427 | 1.631 |
| 11 (comparison) | 0 | 0 | Z | 74 | 0.430 | 1.597 |
| 12 (comparison) | 0 | 0 | 4 Z | 76 | 0.450 | 1.594 |
| 13 (comparison) | X | 0 | 0 | 62 | 0.392 | 1.630 |
| 14 (invention) | X | 0 | 0.6 Z | 152 | 0.374 | 1.719 |
| 15 (invention) | X | 0 | 1.2 Z | 164 | 0.322 | 1.883 |
| 16 (comparison) | 0 | Y | 0 | 72 | 0.400 | 1.644 |
| 17 (comparison) | 0 | Y | 0.6 Z | 76 | 0.418 | 1.637 |
| 18 (comparison) | 0 | Y | 1.2 Z | 75 | 0.431 | 1.612 |

X = 4.8 mg/Ag mol, Y, equivalent to X, = 4.44 mg/Ag mol, Z = 0.66 mg/Ag mol

Data in Table 2 show that samples (14–15) containing the combination of 1 and Au(I) compound have a marked increase in speed, a sharper toe and higher contrast compared to the coatings (samples 10–12) without 1 or the coating (sample 13) containing only 1. Samples (16–18) containing the nitrogen analog of 1, compound Q, either alone or in the presence of Au(I) compound have similar sensitivity (speed), toe and gamma values as that of the control samples (10–12).

The invention has been described in detail with particular reference to preferred embodiments thereof, but it will be understood that variations and modifications can be effected within the spirit and scope of the invention.

I claim:

1. A silver halide photographic emulsion comprising a silver halide emulsion wherein the grains of said emulsion comprise silver chloride said grains are sensitized with a water soluble gold (I) or (III) compound, and said emulsion further comprises a dithiolone dioxide of Formula I

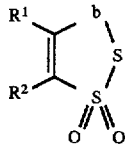

(I)

wherein b is C(O), C(S), C(Se), $CH_2$ or $(CH_2)_2$ and $R^1$ and $R^2$ are independently H or a substituted or unsubstituted aliphatic, aromatic, or heterocyclic group, provided that $R^1$ and $R^2$ together can optionally be joined to form a ring.

2. The emulsion of claim 1 wherein said dithiolone dioxide of the invention comprises at least one number selected from the group consisting of

1

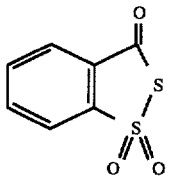

2

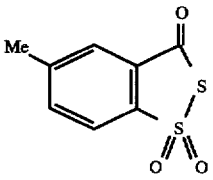

3

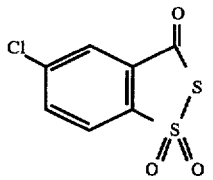

4

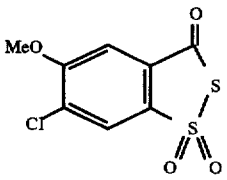

-continued

5

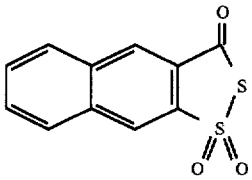

6

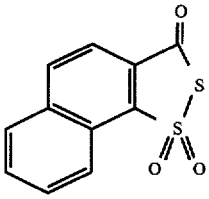

7

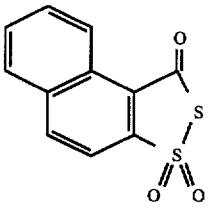

8

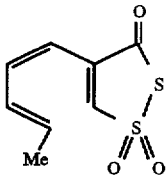

9

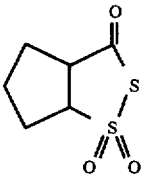

10

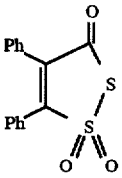

11

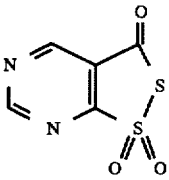

12

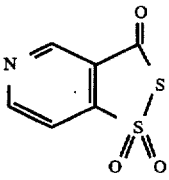

-continued
13
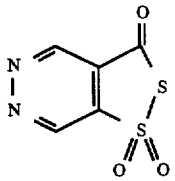
14
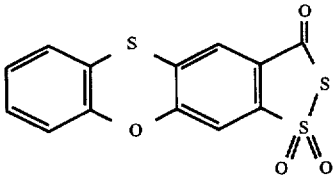
15
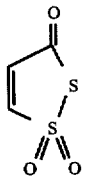
16
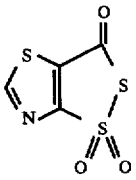
17
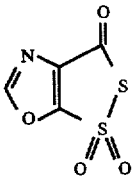
18
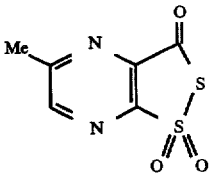
19
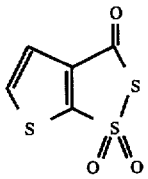
20
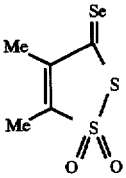
-continued
21
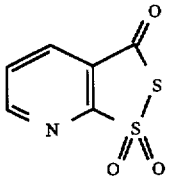
22
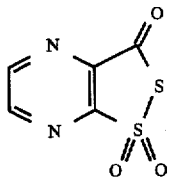
23
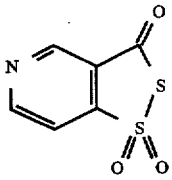
24
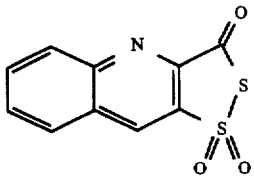
25
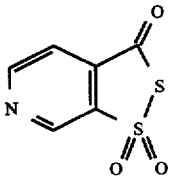
26
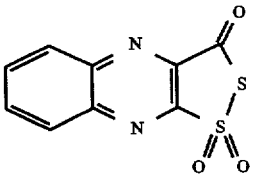
27
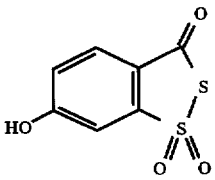
25
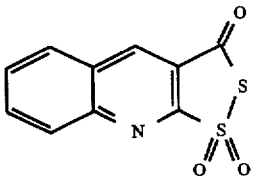

-continued

29 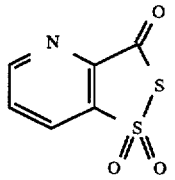

30 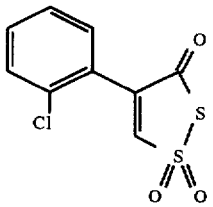

3. The emulsion of claim 1 wherein said dithiolone dioxide comprises

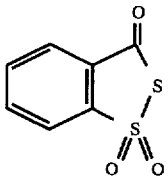

4. The emulsion of claim 1 wherein said water soluble gold sensitizer comprises a gold(I) mesionic thiolate compound.

5. The emulsion of claim 1 wherein said water soluble gold sensitizer comprises a member selected from the group consisting of trisodium aurous dithiosulfate, dithiocyanatoaurate, and potassium tetrachloroaurate.

6. The emulsion of claim 1 wherein said silver chloride grains comprise greater than 95% silver chloride.

7. The emulsion of claim 1 wherein said emulsion is a negative working photographic emulsion.

8. The emulsion of claim 1 wherein the concentration of the dithiolone dioxide is from 0.1 to 100 mg/mol Ag.

9. The emulsion of claim 1 wherein b is C(O).

10. The emulsion of claim 1 wherein b is C(O), C(S), or C(Se); and $R^1$ and $R^2$ together represent the atoms necessary to form a five- or six-membered ring or a multiple ring system.

11. A photographic element comprising at least on a layer comprising a silver halide emulsion wherein the grains of said emulsion comprise silver chloride said grains are sensitized with a water soluble gold(I) or (III) compound, and said emulsion further comprises a dithiolone dioxide of Formula I

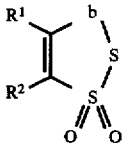

(I)

wherein b is C(O), C(S), C(Se), $CH_2$ or $(CH_2)_2$ and $R^1$ and $R^2$ are independently H or a substituted or unsubstituted aliphatic, aromatic, or heterocyclic group, provided that $R^1$ and $R^2$ together can optionally be joined to form a ring.

12. The element of claim 11 wherein said dithiolone dioxide of the invention comprises at least one number selected from the group consisting of 1 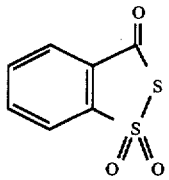

2 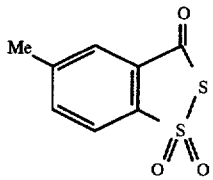

3 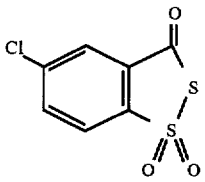

4 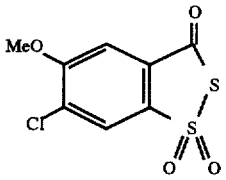

5 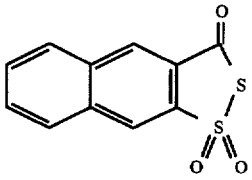

6 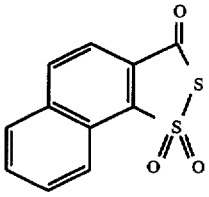

7 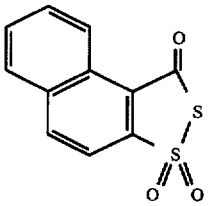

8 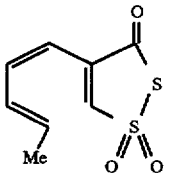

-continued
9
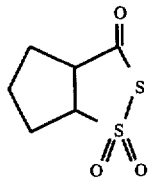
10
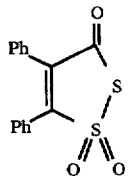
11
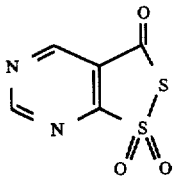
12
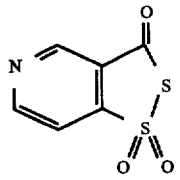
13
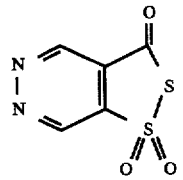
14
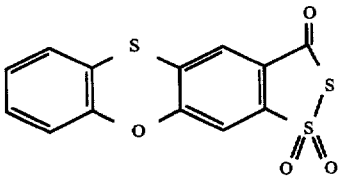
15
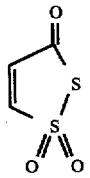
16
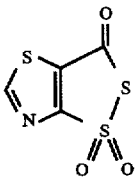
-continued
17
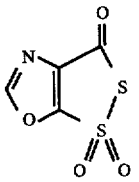
18
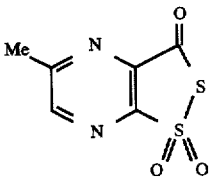
19
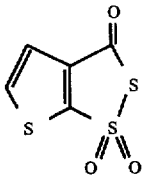
20
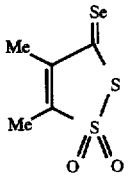
21
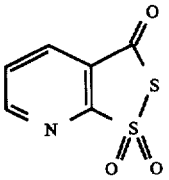
22
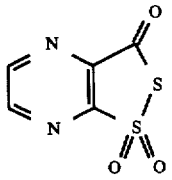
23
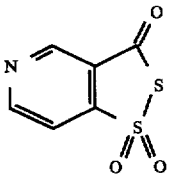
24
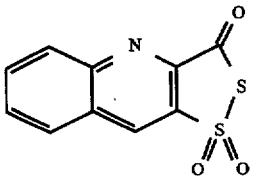

-continued

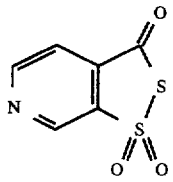

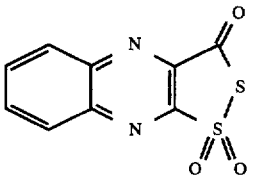

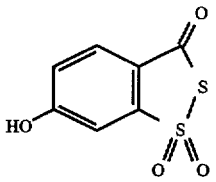

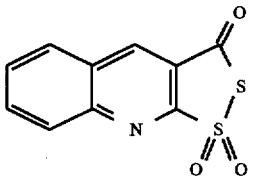

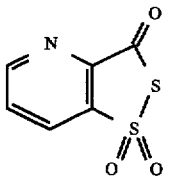

-continued

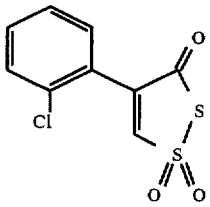

13. The element of claim 11 wherein said dithiolone dioxide comprises

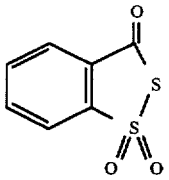

14. The element of claim 11 wherein said water soluble gold sensitizer comprises a gold(I) mesionic thiolate compound.

15. The element of claim 11 wherein said water soluble gold sensitizer comprises a member selected from the group consisting of trisodium aurous dithiosulfate, dithiocyanatoaurate, and potassium tetrachloroaurate.

16. The element of claim 11 wherein said emulsion is a negative working photographic emulsion.

17. The element of claim 11 wherein the concentration of the dithiolone dioxide is from 0.1 to 100 mg/mol Ag.

18. The element of claim 11 wherein b is C(O).

19. The element of claim 11 wherein b is C(O), C(S), or C(Se); and $R^1$ and $R^2$ together represent the atoms necessary to form a five- or six-membered ring or a multiple ring system.

* * * * *